US009883760B2

(12) United States Patent
Jeong

(10) Patent No.: US 9,883,760 B2
(45) Date of Patent: Feb. 6, 2018

(54) DISPOSABLE FOOD GRASPING DEVICE

(71) Applicant: Seong deok Jeong, Gangwon-do (KR)

(72) Inventor: Seong deok Jeong, Gangwon-do (KR)

( * ) Notice: Subject to any disclaimer, the term of this patent is extended or adjusted under 35 U.S.C. 154(b) by 0 days.

(21) Appl. No.: 15/581,271

(22) Filed: Apr. 28, 2017

(65) Prior Publication Data

US 2018/0008071 A1 Jan. 11, 2018

(30) Foreign Application Priority Data

Jul. 11, 2016 (KR) ..... 20-2016-0003990 U

(51) Int. Cl.
*A47G 21/00* (2006.01)
*A41D 13/08* (2006.01)

(52) U.S. Cl.
CPC ..... *A47G 21/001* (2013.01); *A41D 13/087* (2013.01); *A41D 2400/52* (2013.01)

(58) Field of Classification Search
CPC .... A47G 21/001; A47G 21/10; A41D 13/087; A41D 2400/52; A61F 13/104; A61F 13/105; A47J 43/283
See application file for complete search history.

(56) References Cited

U.S. PATENT DOCUMENTS 1,235,199 A * 7/1917 Gavin ..... A41D 13/087 15/246
4,938,515 A * 7/1990 Fazio ..... A41D 13/082 2/21
5,280,661 A * 1/1994 Brown ..... A47L 13/18 15/214
5,749,097 A * 5/1998 Garrett-Roe ..... A41D 13/087 2/21
8,919,838 B2 * 12/2014 Zimmermann ..... A47G 21/10 2/16

FOREIGN PATENT DOCUMENTS

| | | | |
|---|---|---|---|
| JP | H03-4552 | U | 1/1991 |
| KR | 20-0366197 | Y1 | 11/2004 |
| KR | 10-2005-0118049 | A1 | 12/2005 |
| KR | 20-2009-0010796 | U | 10/2009 |
| KR | 10-2011-0002908 | A1 | 1/2011 |

* cited by examiner

*Primary Examiner* — Stephen A Vu
(74) *Attorney, Agent, or Firm* — KORUS Patent, LLC; Seong Il Jeong

(57) ABSTRACT

There is provided a disposable food grasping device comprising: a first finger portion corresponding to an index finger, wherein the first finger portion extends longitudinally; a second finger portion corresponding to a middle finger, wherein the second finger portion extends longitudinally, wherein the first portion is juxtaposed with the second portion; a connection portion commonly coupled to the first finger portion and the second finger portion at proximal ends thereof; a bending portion coupled to the connection portion at an end of the connection portion away from the first and second finger portions, wherein two first folding lines are defined in the bending portion in a width direction thereof and are spaced from each other longitudinally; and a third finger portion corresponding to a thumb, wherein the third finger portion is coupled to the bending portion at one end thereof away from the connection portion.

3 Claims, 12 Drawing Sheets

DISPOSABLE FOOD GRASPING DEVICE

CROSS-REFERENCE TO RELATED APPLICATION

This application claims the benefit of Korean utility model application No. 20-2016-0003990 filed on Jul. 11, 2016, the entire content of which is incorporated herein by reference for all purposes as if fully set forth herein.

BACKGROUND

Field of the Present Disclosure

The present disclosure relates to a disposable food grasping device, and, more particularly, to a disposable food grasping device which allows a user to touch food hygienically without contacting food on the finger.

Discussion of Related Art

As a prior art for the disposable food grasping device, Korean utility model registration No. 20-0366197 discloses a disposable food grasping device including an elongate connection portion having both first and second ends; an index finger accommodation portion coupled to the first end of the connection portion; and a thumb accommodation portion coupled to the second end of the connection portion, wherein, in use, the connection portion is bent such that the index finger accommodation portion and thumb accommodation portion face away each other.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

The present disclosure is to provide a disposable food grasping device having elongate individual portions corresponding to a middle finger, index finger and thumb respectively and arc-shaped bands securing the middle finger, index finger and thumb respectively, thereby to allow easy and accurate food pick-up without contacting the food on the fingers.

In one aspect of the present disclosure, there is provided a disposable food grasping device comprising: a first finger portion corresponding to an index finger, wherein the first finger portion extends longitudinally; a second finger portion corresponding to a middle finger, wherein the second finger portion extends longitudinally, wherein the first portion is juxtaposed with the second portion; a connection portion commonly coupled to the first finger portion and the second finger portion at proximal ends thereof; a bending portion coupled to the connection portion at an end of the connection portion away from the first and second finger portions, wherein the bending portion extends longitudinally, wherein two first folding lines are defined in the bending portion in a width direction thereof and are spaced from each other longitudinally; and a third finger portion corresponding to a thumb, wherein the third finger portion is coupled to the bending portion at one end thereof away from the connection portion and extends from the bending portion longitudinally.

In one implementation, the device further comprises a first arc-shaped band horizontally extending from one side of the first finger portion and bending toward the other side of the first finger portion, wherein the first arc-shaped band surrounds the index finger; a second arc-shaped band horizontally extending from one side of the second finger portion and bending toward the other side of the second finger portion, wherein the second arc-shaped band surrounds the middle finger; a third arc-shaped band horizontally extending from one side of the connection portion and bending toward the other side of the connection portion, wherein the third arc-shaped band surrounds the index and middle finger; and a fourth arc-shaped band horizontally extending from one side of the third finger portion and bending toward the other side of the third finger portion, wherein the fourth arc-shaped band surrounds the thumb.

In one implementation, the device further comprises a multiple folding lines portion between the first finger portion and the second finger portion, wherein the multiple folding lines portion has second folding lines defined therein, wherein the multiple folding lines portion has an circular arc shape, and the second folding lines extend radially and are spacedly arranged.

In one implementation, the bending portion is bent such that the first finger portion and the second finger portion face away the third finger portion, and the first, second, third finger portions, the connection portion, the bending portion, and the first, second, third, and fourth bands, and the multiple folding lines portion are monolithic.

In one implementation, the device further comprises a first cover portion extending from a distal end of the first finger portion and bending toward and attached to the first arc-shaped band; a second cover portion extending from a distal end of the second finger portion and bending toward and attached to the second arc-shaped band; and a third cover portion extending from a distal end of the third finger portion and bending toward and attached to the fourth arc-shaped band.

In one implementation, the bending portion has third folding lines defined in an end area thereof adjacent to the connection portion, wherein the third folding lines include two diagonal lines intersecting each other and a horizontal line passing the intersection of the diagonal lines.

In accordance with the present disposable food grasping device, the user touches the food using the first finger portion, the second finger portion and the third finger portion. In this connection portion, since back faces of the first finger portion, the second finger portion, and third finger portion contact the food, the user's fingers do not touch any food or spices. Thus, the user may handle the food hygienically.

In particular, the connection portion is provided with the third arc-shaped band which surrounds the proximal ends of the index and middle fingers, so that the connection portion is brought into close contact with the palm of the hand, thereby minimizing the food from getting on the palm of the hand. This may further realize an effect of improving the coupling between the fingers and the device.

In addition, since the first folding lines are formed in the bending portion at a predetermined interval in the longitudinal direction thereof, the connection portion and the third finger portion are smoothly folded to facilitate the use of the present device when the food is picked up.

Further, the bending portion has the second folding line having the two diagonal lines and one middle horizontal line, so that both sides of the end of the bending portion adjacent to the connection portion are wrinkled. Thus, the first finger portion and the second finger portion may be smoothly tilted or twisted at a certain angle in both directions.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

Figure 1:
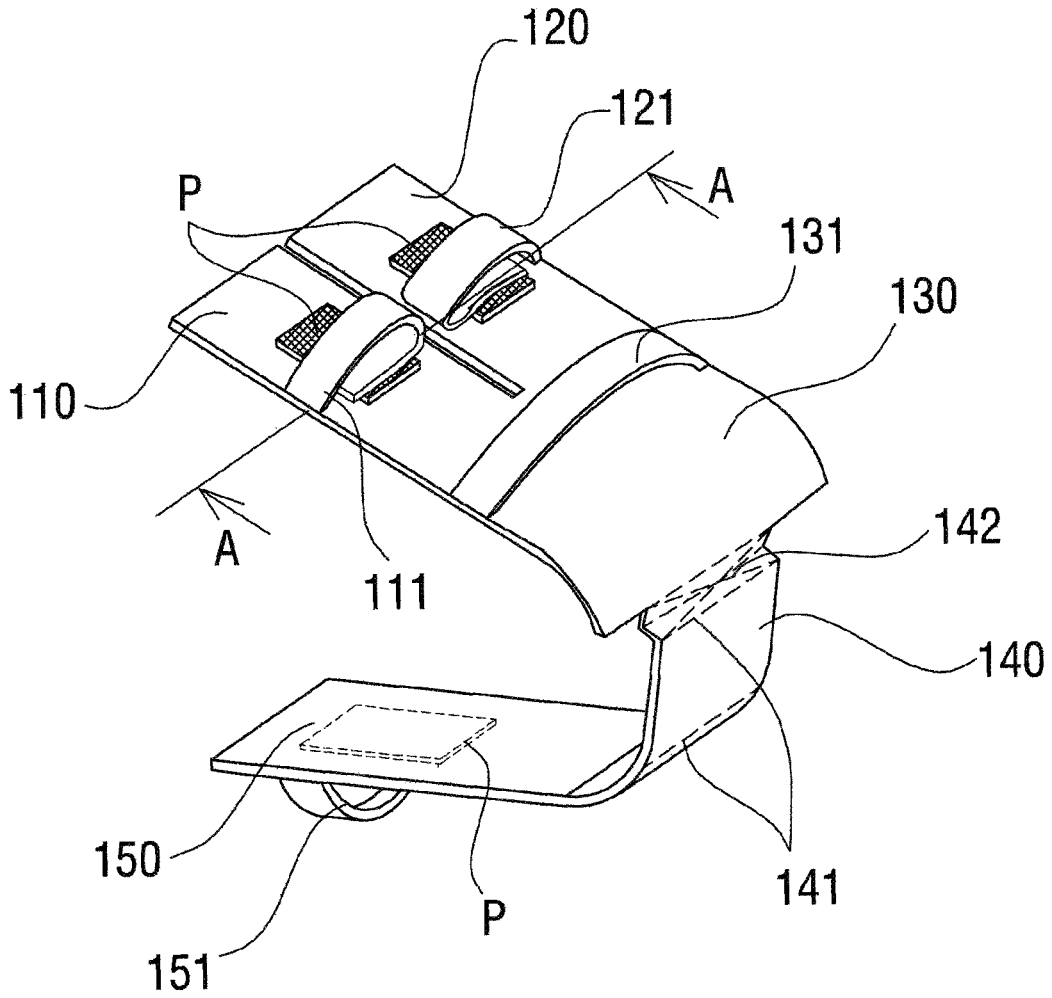
FIG. 1 is a perspective view of a disposable food grasping device in accordance with a first embodiment of the present disclosure.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

DETAILED DESCRIPTIONS

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure."

FIRST EMBODIMENT

Figure 2:
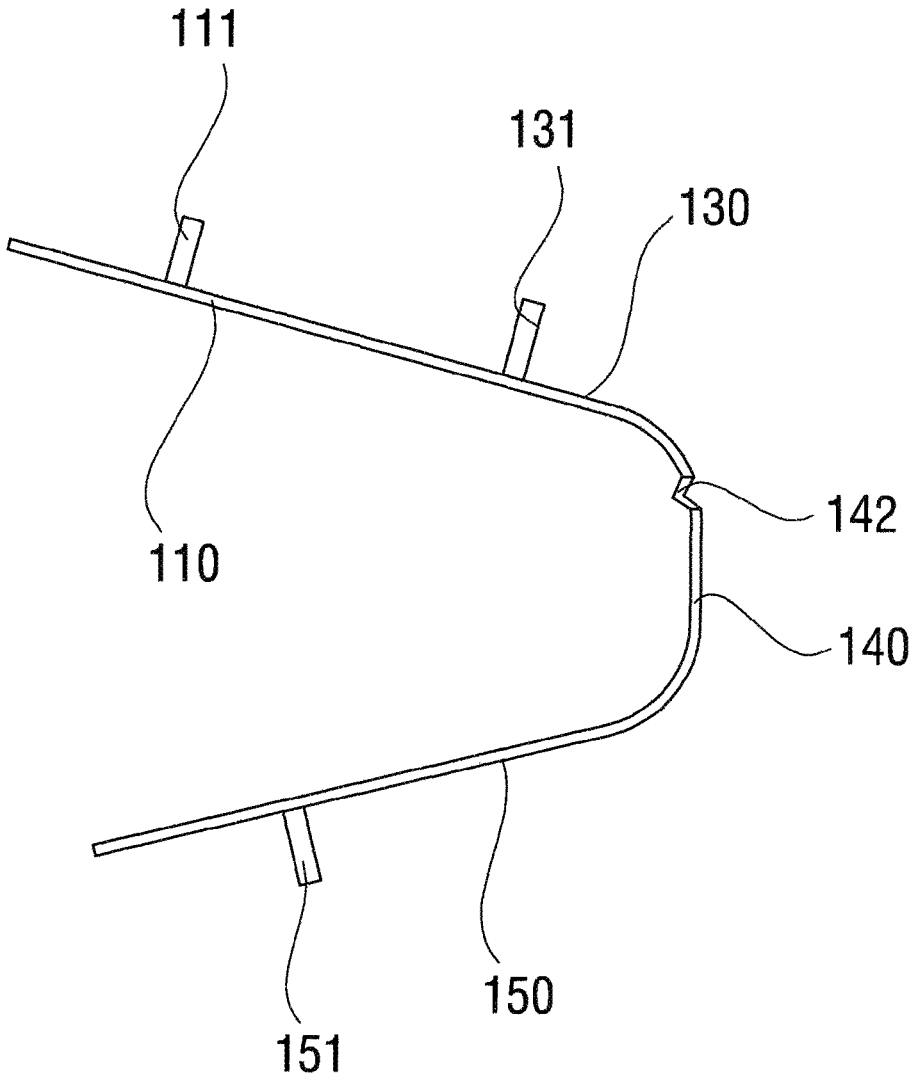
FIG. 2 a side elevation view of a disposable food grasping device in accordance with a first embodiment of the present disclosure.
Figure 3:
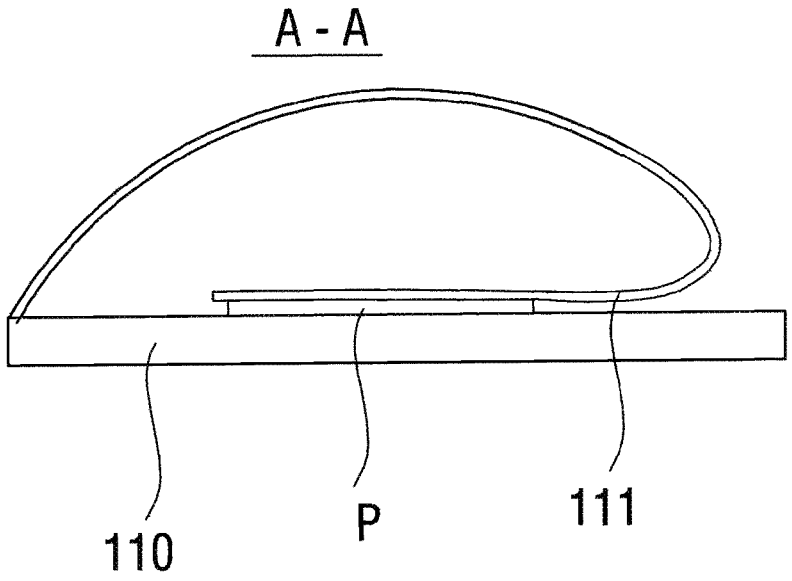
FIG. 3 is a cross-sectional view of a portion of the disposable food grasping device taken at a line A-A in FIG. 1.
Figure 4:
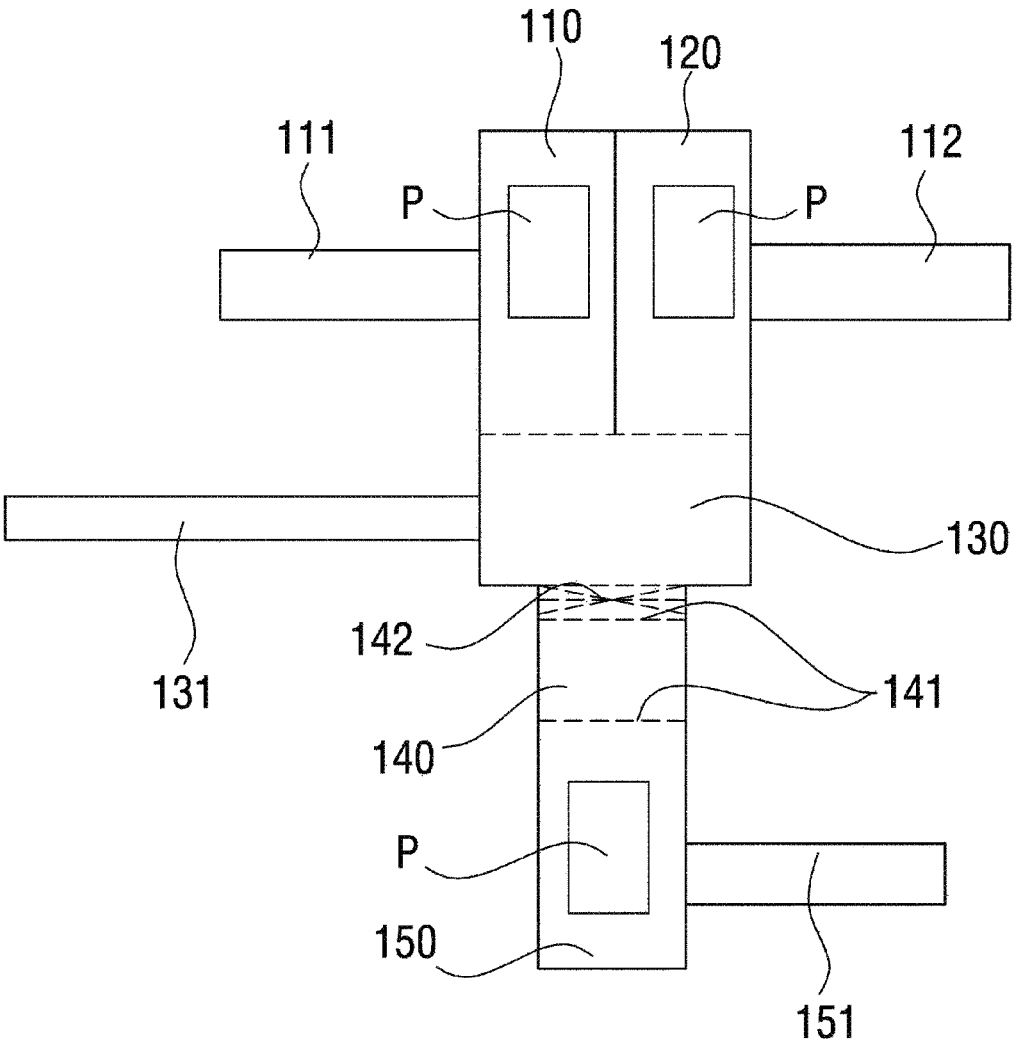
FIG. 4 is a stretched view of a disposable food grasping device in accordance with a first embodiment of the present disclosure.

FIG. 1 is a perspective view of a disposable food grasping device in accordance with a first embodiment of the present disclosure. FIG. 2 a side elevation view of a disposable food grasping device in accordance with a first embodiment of the present disclosure. FIG. 3 is a cross-sectional view of a portion of the disposable food grasping device taken at a line A-A in FIG. 1. FIG. 4 is a stretched view of a disposable food grasping device in accordance with a first embodiment of the present disclosure.

Referring to FIG. 1 to FIG. 4, a disposable food grasping device in accordance with a first embodiment of the present disclosure may include a first finger portion 110, a second finger portion 120, a connection portion 130, a bending portion 140, and a third finger portion 150.

The components of the disposable food grasping device in accordance with a first embodiment of the present disclosure may be monolithic and may be made of a paper. As shown in FIG. 3, the flat paper may be cut and, then, may be bent as shown in FIG. 2.

Specifically, the first finger portion 110 is a portion where the index finger is placed, and has a rectangular shape that is long in the longitudinal direction of the index finger.

Further, the first finger portion 110 has a pad P attached thereon with a low heat transfer. The pad P is affixed to the front face of the first finger portion 110 to minimize the heat transfer of food heat to the finger, allowing for easy picking up of hot food and preventing finger burn from the food heat.

In addition, an adhesive sheet is formed on the upper surface of the pad P, and a first arc-shaped band 111, which will be described later, is attached and fixed to the pad P via the adhesive sheet.

In this connection portion, the present device is commercialized while the adhesive sheet is covered with a release paper. Thus, in use, the release paper is removed and the first arc-shaped band 111 is attached to the pad P via the adhesive sheet.

The area of the adhesive sheet is wider than the first arc-shaped band 111 described below. An area of the adhesive sheet, which is not covered by the first arc-shaped band 111, adheres to the finger, thereby allowing the finger to be attached to the adhesive sheet of the first finger portion 110 to prevent the human finger from being removed easily from the present device.

The first arc-shaped band 111 extends horizontally from one side, that is, outer side, of the first finger portion 110. In use, the first arc-shaped band 111 may be bent such the distal end of thereof is fixed to the adhesive sheet.

The first arc-shaped band 111 is bent in a direction toward the second finger portion 120, which will be described later so as to surround the distal end of the index finger disposed on the upper surface of the first finger portion 110. As a result, as shown in FIG. 3, the distal end of the first arc-shaped band 111 is bent to form a desired arc length of the band 111 and is fixed to the adhesive sheet formed on the upper surface of the pad P.

Of course, the first arc-shaped band 111 may be length-adjustably mounted on the first finger portion 110, if necessary.

Figure 7:
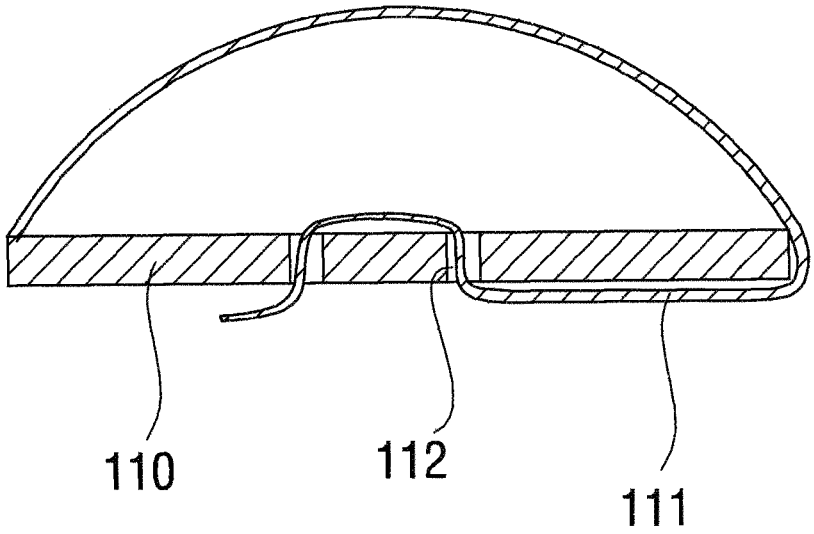
FIG. 7 is a cross-sectional view of a portion of a disposable food grasping device in accordance with another embodiment of the present disclosure.

Specifically, as shown in FIG. 7, two openings 112 may be formed in the first finger portion 110 at a regular interval in the width direction.

The openings 112 may be cut in the thickness direction of the paper. As shown in FIG. 7, the end of the first arc-shaped band 111 passes through the openings 112 sequentially.

When the distal free end of the first arc-shaped band 111 is inserted into the openings 112 with a pulling force, the length of the arc of the band may be adjusted to the diameter of the index finger arranged on the first finger portion 110. As the first arc-shaped band 111 is pressed down, a portion of the distal end the first arc-shaped band 111 on the pad P between the openings 112 may be attached and fixed to the adhesive sheet so that the band is not easily separated from the openings 112.

By providing the openings 112 in the first finger portion 110, the arc length of the first arc-shaped band 111 may be adjusted to the diameter size of the finger, thereby improving the fixing force between the index finger and the first finger portion 110.

This opening 112 configuration may also be equally applied to the second finger portion 120, the connection portion 130 and the third finger portion 150, respectively.

On the other hand, the second finger portion 120 has the same elongate rectangular shape as that of the first finger portion 110. The second finger portion 120 is disposed adjacent to the first finger portion 110.

Specifically, the second finger portion 120 is a portion where the middle finger is placed, and has a rectangular shape that is long in the longitudinal direction of the middle finger.

Further, the second finger portion 120 has a pad P attached thereon with a low heat transfer. The pad P is affixed to the front face of the second finger portion 120 to minimize the heat transfer of food heat to the finger, allowing for easy picking up of hot food and preventing finger burn from the food heat.

In addition, an adhesive sheet is formed on the upper surface of the pad P, and a second arc-shaped band 121, which will be described later, is attached and fixed to the pad P via the adhesive sheet.

In this connection portion, the present device is commercialized while the adhesive sheet is covered with a release paper. Thus, in use, the release paper is removed and the second arc-shaped band 121 is attached to the pad P via the adhesive sheet.

The area of the adhesive sheet is wider than the second arc-shaped band 121 described below. An area of the adhesive sheet, which is not covered by the second arc-shaped band 121, adheres to the finger, thereby allowing the finger to be attached to the adhesive sheet of the second finger portion 120 to prevent the human finger from being removed easily from the present device.

The second arc-shaped band 121 extends horizontally from one side, that it, an outer side, of the second finger portion 120. In use, the second arc-shaped band 121 may be bent such the distal end of thereof is fixed to the adhesive sheet.

The second arc-shaped band 121 is bent in a direction toward the second finger portion 120, which will be described later so as to surround the distal end of the middle finger disposed on the upper surface of the second finger portion 120. As a result, as shown in FIG. 3, the distal end of the second arc-shaped band 121 is bent to form a desired arc length of the band 121 and is fixed to the adhesive sheet formed on the upper surface of the pad P.

Of course, the second arc-shaped band 121 may be length-adjustably mounted on the second finger portion 120, if necessary.

Specifically, as shown in FIG. 7, two openings 112 may be formed in the second finger portion 120 at a regular interval in the width direction.

The openings 112 may be cut in the thickness direction of the paper. As shown in FIG. 7, the end of the second arc-shaped band 121 passes through the openings 112 sequentially.

When the distal free end of the second arc-shaped band 121 is inserted into the openings 112 with a pulling force, the length of the arc of the band may be adjusted to the diameter of the middle finger arranged on the second finger portion 120. As the second arc-shaped band 121 is pressed down, a portion of the distal end the second arc-shaped band 121 on the pad P between the openings 112 may be attached and fixed to the adhesive sheet so that the band is not easily separated from the openings 112.

By providing the openings 112 in the second finger portion 120, the arc length of the second arc-shaped band 121 may be adjusted to the diameter size of the finger, thereby improving the fixing force between the middle finger and the second finger portion 120.

The connection portion 130 is connected to both of the first finger portion 110 and the second finger portion 120 at proximal ends thereof and is formed in a rectangular shape having the same width as a sum of widths of the first finger portion 110 and the second finger portion 120.

In use, on the upper face of the connection portion 130, the proximal ends of the index finger and the middle finger are disposed together. The connection portion 130 is positioned adjacent to the palm area.

In addition, a third arc-shaped band 131 having a long strip shape extends from one side of the connection portion 130.

The third arc-shaped band 131 may be bent toward the other side of the connection portion 130. The distal end of the band 131 may be fixed to a back face of the connection portion 130 with an adhesive or the like.

This third arc-shaped band 131 wraps around the proximal ends of the index finger and the middle finger.

In this way, the first arc-shaped band 111 and the second arc-shaped band 121 is provided on the first finger portion 110 and the second finger portion 120, respectively, and the third arc-shaped band 131 is provided on the connection portion 130, such that the distal ends and the proximal ends of the index and middle fingers are doubly wrapped to prevent the fingers from being easily removed from the present device. Furthermore, the connection portion 130 and the bending portion 140, described below, are in close contact with the palm of the user hand, thereby minimizing food from touching the users' palm.

The bending portion 140 is elongated and extends from the connection portion 130 in the opposite direction to the first and second finger portions 110 and 120. The bending portion 140 has a rectangular shape narrower than the connection portion 130. The bending portion 140 allows the connection portion 130 and a third finger portion 150, which will be described later to face each other when food is picked up by the present device via bending of the bending portion 140.

Specifically, in the bending portion 140, two first folding lines 141 that extend in the width direction of the portion 140 are spaced apart from each other in the longitudinal direction of the portion 140.

Each of the first folding lines 141 may be formed in a manner such that a serials of linear cut dots may be formed along each first folding line 141 at a predetermined interval. Alternatively, each of the first folding lines 141 may be formed in a manner such that a pressure is applied to the portion 140 along each folding line 141.

Each first folding line 141 serves as a hinge so that when the food is picked up, the connection portion 130 and the third finger portion 150, which will be described later, face easily each other on the basis of the first folding line 141. This allows easy and accurate use of the grasping device.

The bending portion 140 also has a second folding line 142 defined on the end thereof toward the connection portion 130.

The second folding line 142 is shown in FIG. 4. The second folding line 142 is formed between the connection portion 130 and the first folding line 141 adjacent to the connection portion 130. The second folding line 142 is composed of two diagonal lines intersecting each other and a horizontal line passing the intersection of the diagonal lines. That is, the second folding line 142 is formed in the same shape as a 90 degrees rotation of "*".

The second folding lines 142 may be formed in a manner such that a serials of linear cut dots may be formed along the second folding line 142 at a predetermined interval. Alternatively, the second folding line 142 may be formed in a manner such that a pressure is applied to the portion 140 along the second folding line 142, that is, the two diagonal lines and the middle horizontal line.

The second folding line 142 is bent in a V-shape in the thickness direction so that the connection portion 130 is twisted relative to the bending portion 140 at a predetermined angle. That is, as shown in FIG. 2, the second folding line 142 is bent in a V-shape in the thickness direction. Thus, this may allow the first finger portion 110 and the second finger portion 120 to twist or tilt smoothly at a predetermined angle in both directions in use of the present device.

On the other hand, the third finger portion 150 is elongated and extends from the bending portion 140 in a direction opposite to the finger portions 110 and 120. The third finger portion 150 is formed in a rectangular shape.

In use, a thumb may be disposed on the front surface of the third finger portion 150. Further, a fourth arc-shaped band 151 extends horizontally from one side of the third finger portion 150.

The fourth arc-shaped band 151 is bent to the other side of the third finger portion 150 so as to surround the thumb disposed on the front surface of the third finger portion 150. The distal end of the fourth arc-shaped band 151 is fixedly attached to the back surface of the third finger portion 150 via an adhesive.

Regarding the operation of the disposable food grasping device in accordance with the first embodiment, the user may place the index and middle fingers on the first finger portion 110 and the second finger portion 120 respectively so as to be fit into the first and second arc-shaped bands 111 and 121, and, at the same time, place a thumb on the third finger portion 150 so as to be fit into the third arc-shaped band 151. In this state, the user may pick up food via bending of the bending portion 140.

In this way, the user touches the food using the first finger portion 110, the second finger portion 120 and the third finger portion 150. In this connection portion, since back faces of the first finger portion 110, the second finger portion 120, and third finger portion 150 contact the food, the user's fingers do not touch any food or spices. Thus, the user may handle the food hygienically.

In particular, the connection portion 130 is provided with the third arc-shaped band 131 which surrounds the proximal ends of the index and middle fingers, so that the connection portion 130 is brought into close contact with the palm of the hand, thereby minimizing the food from getting on the palm of the hand. This may further realize an effect of improving the coupling between the fingers and the device.

In addition, since the first folding lines 141 are formed in the bending portion 140 at a predetermined interval in the longitudinal direction thereof, the connection portion 130 and the third finger portion 150 are smoothly folded to facilitate the use of the present device when the food is picked up.

Further, the bending portion 140 has the second folding line 142 having the two diagonal lines and one middle horizontal line, so that both sides of the end of the bending portion 140 adjacent to the connection portion 130 are wrinkled. Thus, the first finger portion 110 and the second finger portion 120 may be smoothly tilted or twisted at a certain angle in both directions.

SECOND EMBODIMENT

Figure 5:
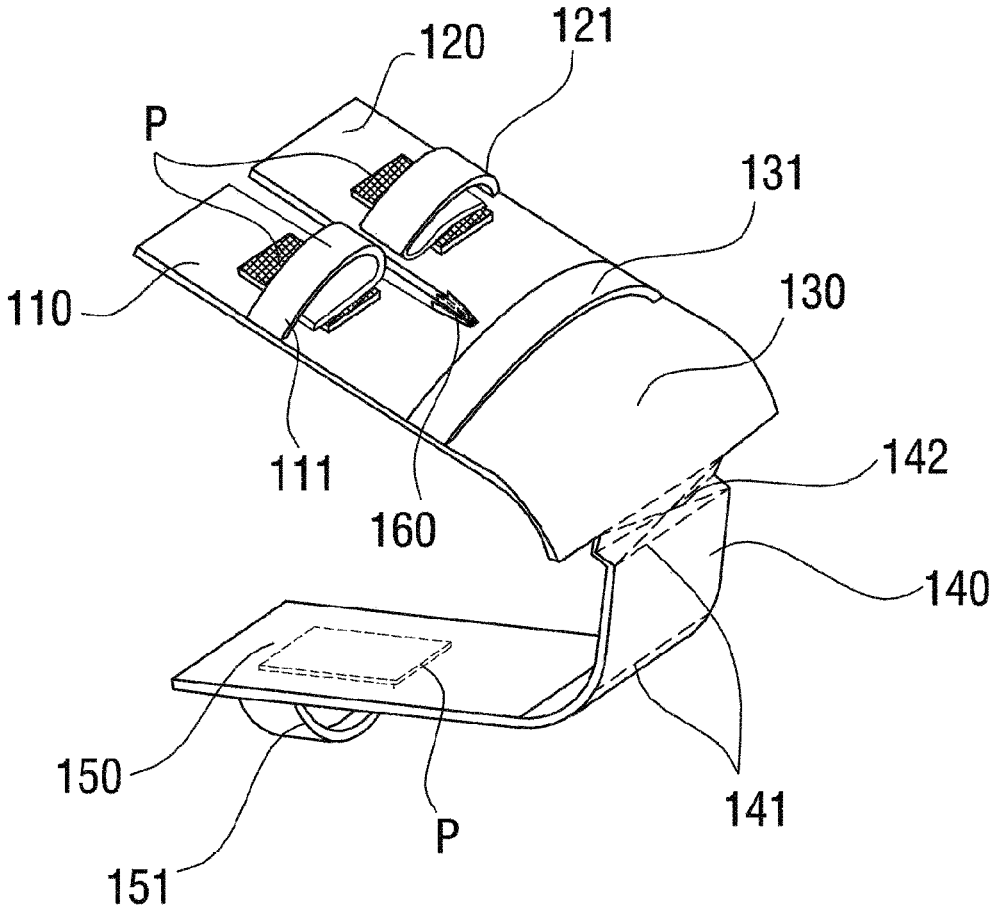
FIG. 5 is a perspective view of a disposable food grasping device in accordance with a second embodiment of the present disclosure.
Figure 6:
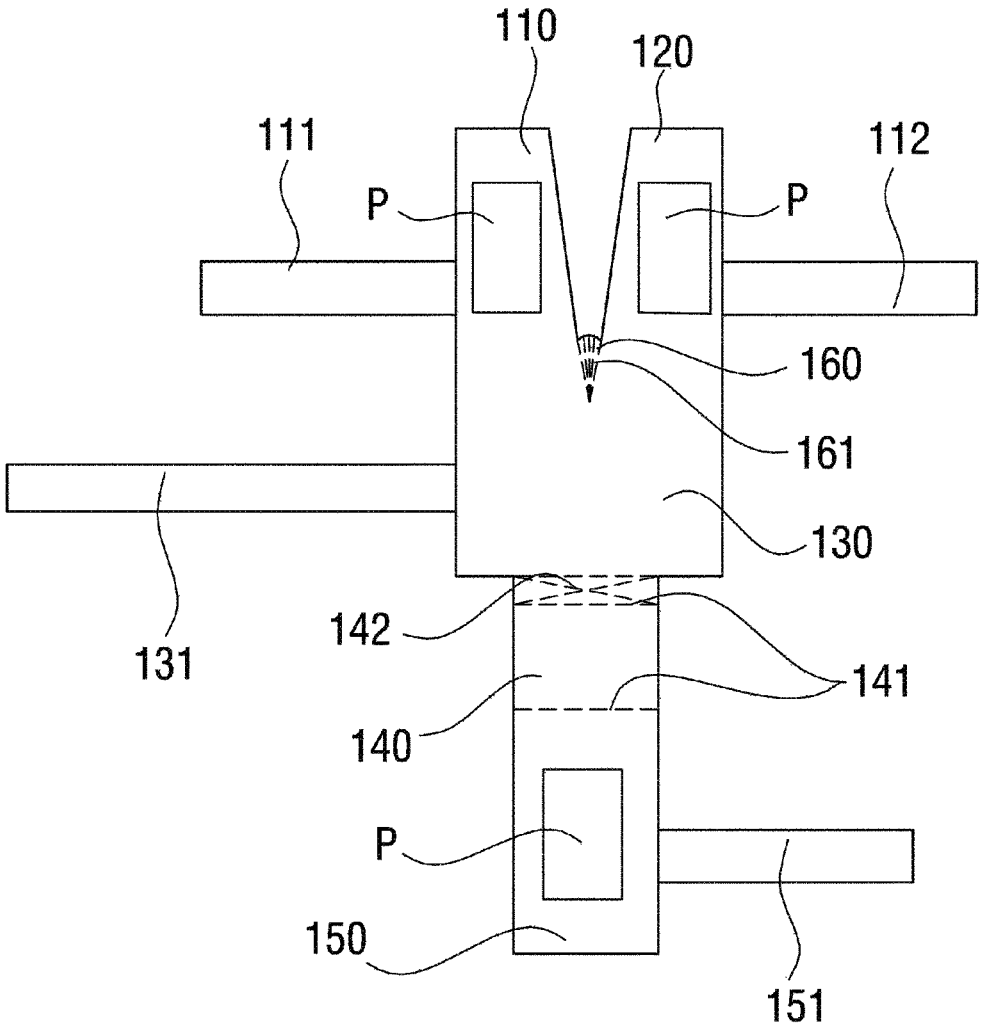
FIG. 6 is a stretched view of a disposable food grasping device in accordance with a second embodiment of the present disclosure.

FIG. 5 is a perspective view of a disposable food grasping device in accordance with a second embodiment of the present disclosure. FIG. 6 is a stretched view of a disposable food grasping device in accordance with a second embodiment of the present disclosure.

The disposable food grasping device in accordance with a second embodiment of the present disclosure has substantially the same configuration as that of the disposable food grasping device in accordance with the first embodiment of the present disclosure except that a multiple folding lines portion 160 is formed between the first and second finger portions 110 and 120.

As shown FIG. 5 and FIG. 6, the multiple folding lines portion 160 may be formed as a circular arc portion between the first finger portion 110 and the second finger portion 120.

The multiple folding lines portion 160 has a plurality of third folding lines 161 defined therein that extend in the radial direction. The third folding lines 161 are alternately folded in mutually opposite directions so that the multiple folding lines portion 160 may be enlarged or shortened in a circular direction.

In this way, the multiple folding lines portion 160 may allow the space between the first finger portion 110 and the second finger portion 120 to be enlarged or shortened in a circular direction, and, thus, the angle between the first finger portion 110 and the second finger portion 120 is adjusted. This may allow the user to pick up food more stably or more efficiently.

THIRD EMBODIMENT

Figure 8:
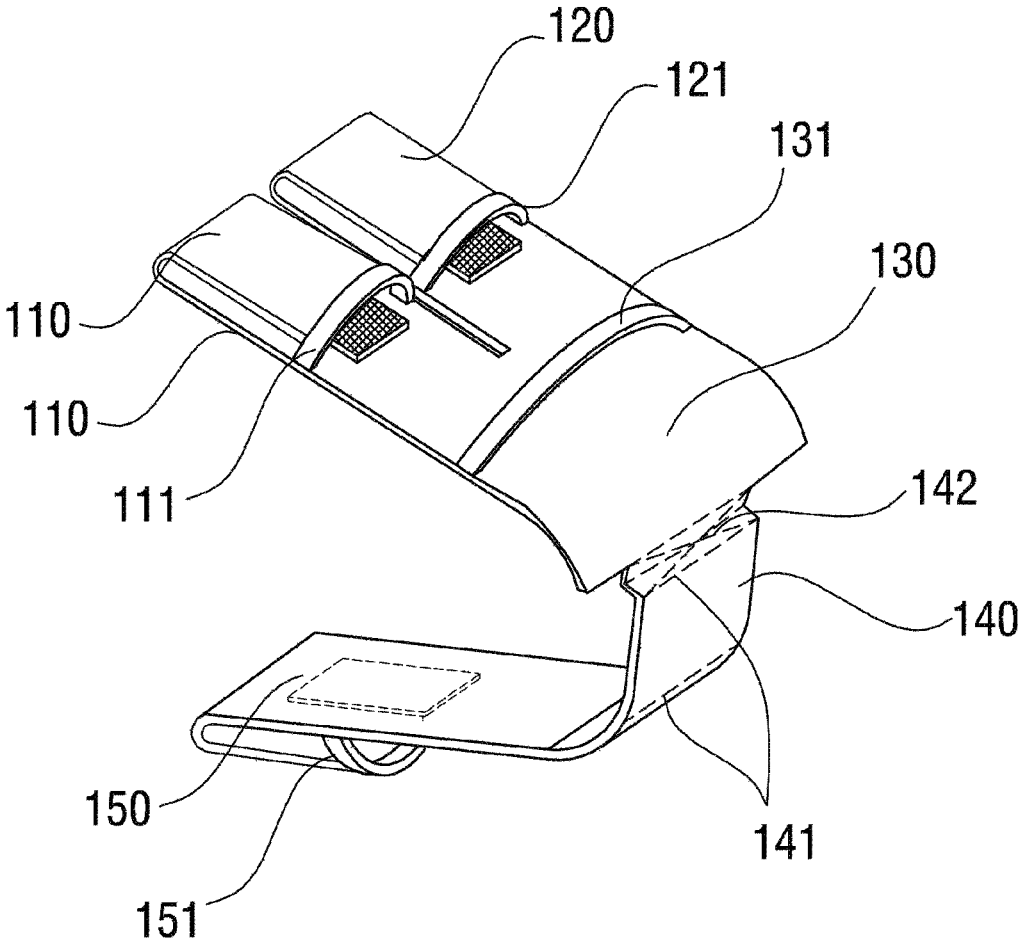
FIG. 8 is a perspective view of a disposable food grasping device in accordance with a third embodiment of the present disclosure.
Figure 9:
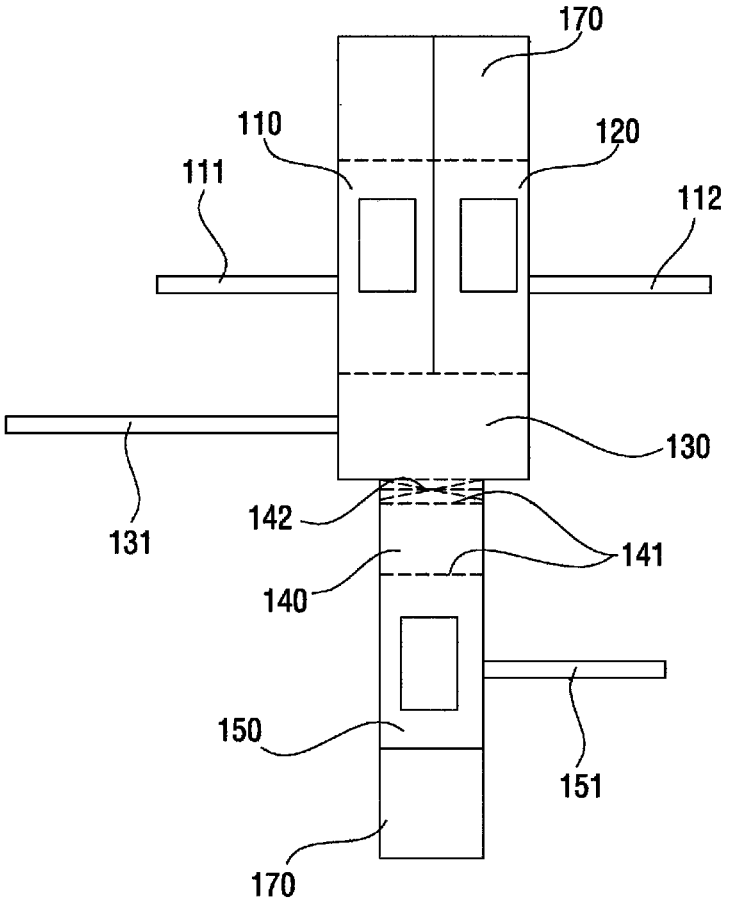
FIG. 9 is a stretched view of a disposable food grasping device in accordance with a third embodiment of the present disclosure.

FIG. 8 is a perspective view of a disposable food grasping device in accordance with a third embodiment of the present disclosure. FIG. 9 is a stretched view of a disposable food grasping device in accordance with a third embodiment of the present disclosure.

The disposable food grasping device in accordance with a third embodiment of the present disclosure has substantially the same configuration as that of the disposable food grasping device in accordance with the first embodiment of the present disclosure except that first cover portions 170 connecting with the first finger portion 110, the second finger portion 120 and the third finger portion 150 at the distal ends thereof respectively are formed.

As shown in FIG. 8 and FIG. 9, each of the first cover portions 170 may extend in a length-direction from the first finger portion 110, the second finger portion 120 and the third finger portion 150 at the distal ends thereof respectively. In use, each of the first cover portions 170 may be bent toward and attached to the first arc-shaped band 111, the second arc-shaped band 121 and the fourth arc-shaped band 151 respectively.

In this way, the first cover portions 170 connecting with the first finger portion 110, the second finger portion 120 and the third finger portion 150 at the distal ends thereof respectively and being bent toward and attached to the first arc-shaped band 111, the second arc-shaped band 121 and the fourth arc-shaped band 151 respectively may allow the tip ends of the fingers to be prevented from contacting the food.

FOURTH EMBODIMENT

Figure 10:
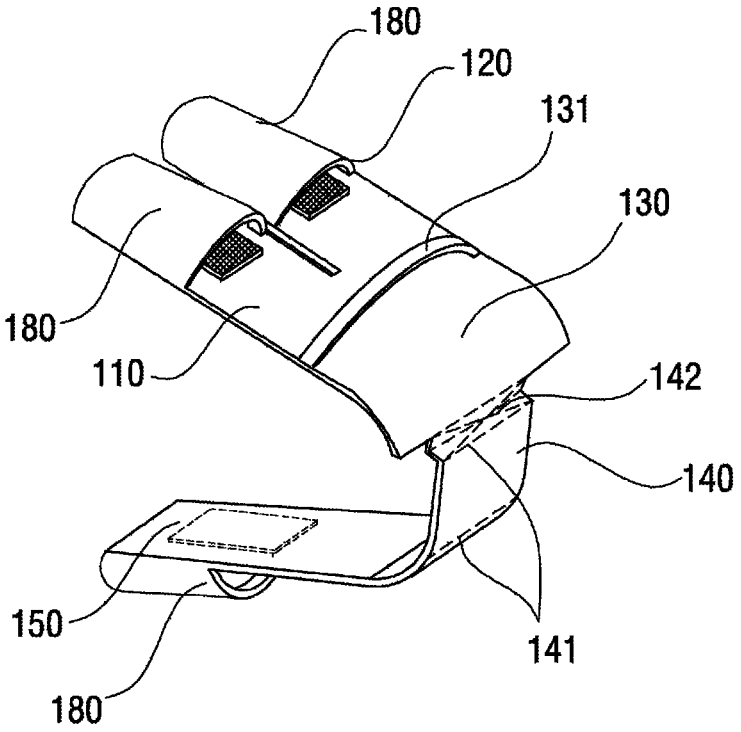
FIG. 10 is a perspective view of a disposable food grasping device in accordance with a fourth embodiment of the present disclosure.
Figure 11:
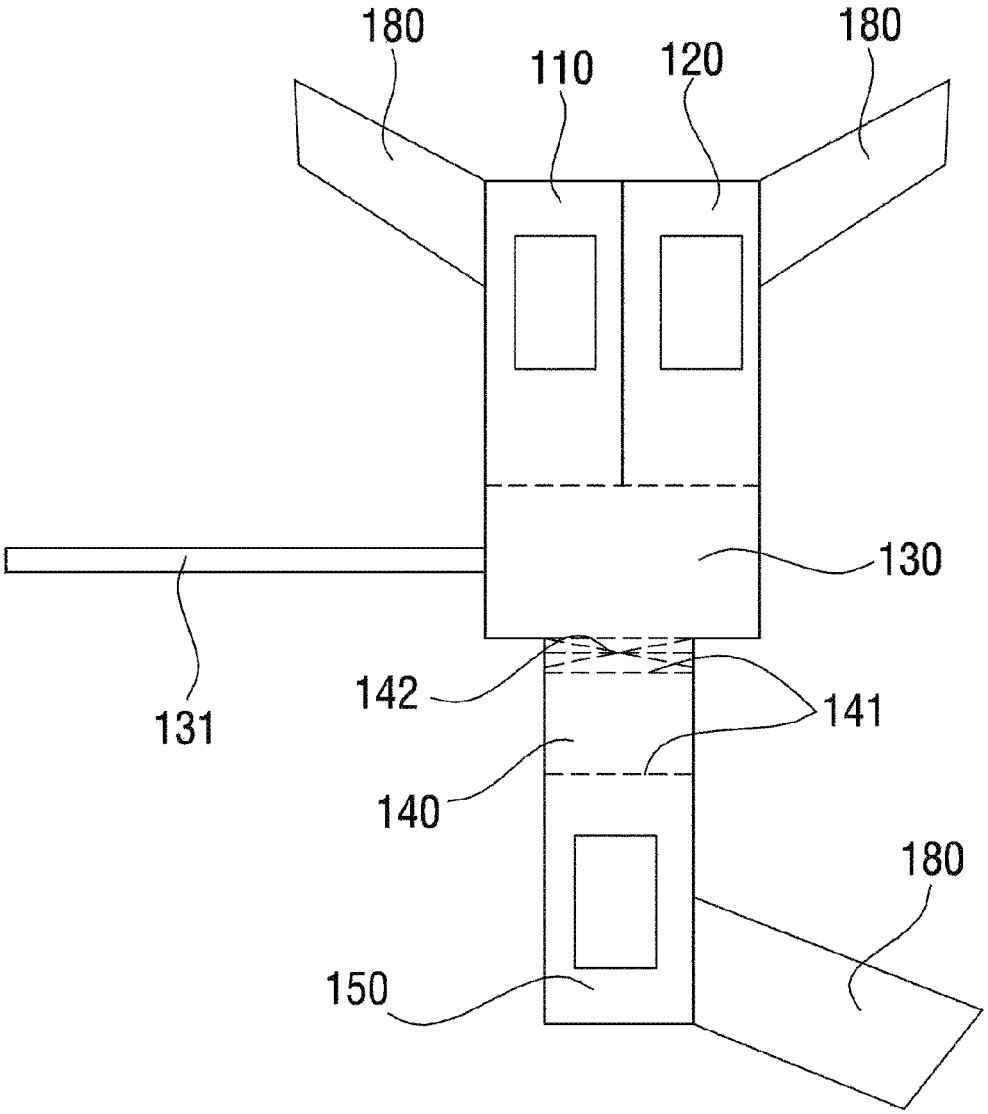
FIG. 11 is a stretched view of a disposable food grasping device in accordance with a fourth embodiment of the present disclosure.

FIG. 10 is a perspective view of a disposable food grasping device in accordance with a fourth embodiment of the present disclosure. FIG. 11 is a stretched view of a disposable food grasping device in accordance with a fourth embodiment of the present disclosure.

The disposable food grasping device in accordance with a fourth embodiment of the present disclosure has substantially the same configuration as that of the disposable food grasping device in accordance with the first embodiment of the present disclosure except that second cover portions 180 connecting with the first finger portion 110, the second finger portion 120 and the third finger portion 150 at the distal ends thereof respectively are formed.

As shown in FIG. 10 and FIG. 11, each of the second cover portions 180 may extend obliquely from the first finger portion 110, the second finger portion 120 and the third finger portion 150 at sides thereof adjacent to the distal ends thereof respectively.

Specifically, as shown in FIG. 11, one second cover portion 180 inclinedly extends to the left from the first finger portion 110 at the left side thereof and are folded to the right such that the distal end thereof is attached to the rear surface of the first finger portion 110. Another second cover portion 180 inclinedly extends to the right from the second finger portion 120 at the right side thereof and are folded to the left such that the distal end thereof is attached to the rear surface of the second finger portion 120.

In addition, as shown in FIG. 11, still another second cover portion 180 extends inclinedly to the right from the third finger portion 150 at the right side thereof and are folded to the left such that the distal end thereof is attached to the rear surface of the third finger portion 150.

In this connection portion, each of the second cover portions 180 may be formed to be wider than each of the first arc-shaped band 111, the second arc-shaped band 121 and the fourth arc-shaped band 151 in the first embodiment.

In this way, the second cover portions 180 connecting with the first finger portion 110, the second finger portion 120 and the third finger portion 150 at the distal ends thereof respectively and being bent toward and attached to the rear faces of the first finger portion 110, the second finger portion 120 and the third finger portion 150 respectively may surround the distal ends of the fingers respectively such that the fingers may be prevented from contacting the food.

FIFTH EMBODIMENT

Figure 12:
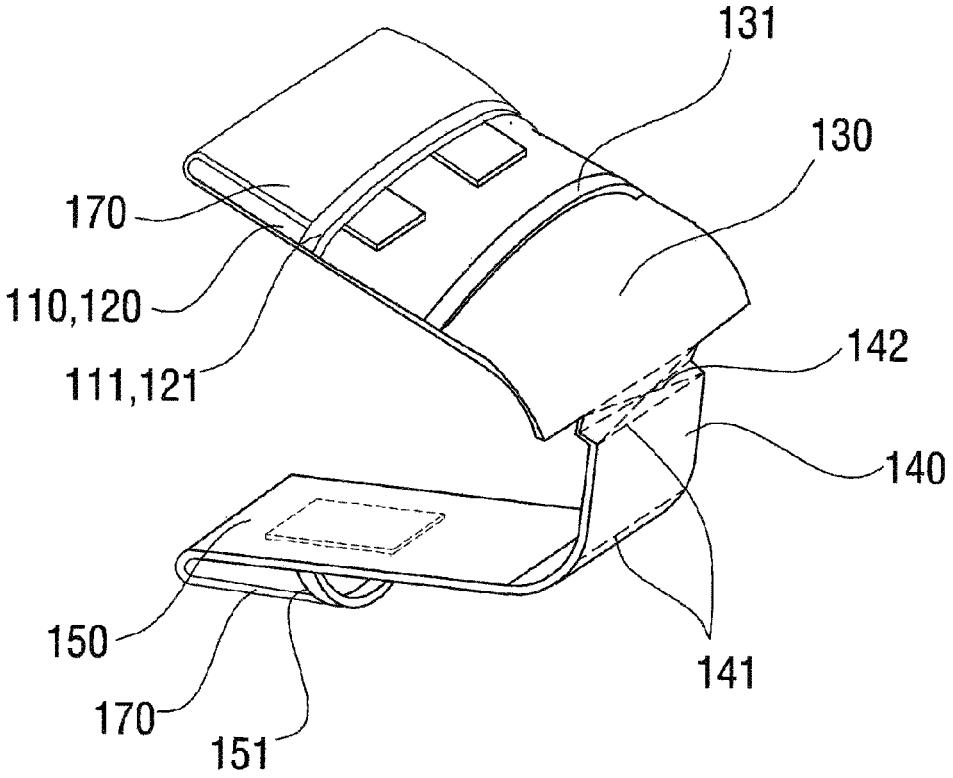
FIG. 12 is a perspective view of a disposable food grasping device in accordance with a fifth embodiment of the present disclosure.

FIG. 12 is a perspective view of a disposable food grasping device in accordance with a fifth embodiment of the present disclosure.

The disposable food grasping device in accordance with a fifth embodiment of the present disclosure has substantially the same configuration as that of the disposable food grasping device in accordance with the third embodiment of the present disclosure except that the separated first cover portions 170 corresponding to the first finger portion 110 and second finger portion 120 respectively is integrated into a single first cover portion 170.

In this way, the first cover portions 170 connecting with the first finger portion 110, the second finger portion 120 and the third finger portion 150 at the distal ends thereof respectively and being bent toward and attached to the first arc-shaped band 111, the second arc-shaped band 121 and the fourth arc-shaped band 151 respectively may allow the tip ends of the fingers to be prevented from contacting the food.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection portion with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A disposable food grasping device comprising:

a first finger portion corresponding to an index finger, wherein the first finger portion extends longitudinally;

a second finger portion corresponding to a middle finger, wherein the second finger portion extends longitudinally, wherein the first portion is juxtaposed with the second portion;

a connection portion commonly coupled to the first finger portion and the second finger portion at proximal ends thereof;

a bending portion coupled to the connection portion at an end of the connection portion away from the first and second finger portions, wherein the bending portion extends longitudinally, wherein two folding lines are defined in the bending portion in a width direction thereof and are spaced from each other longitudinally;

a third finger portion corresponding to a thumb, wherein the third finger portion is coupled to the bending portion at one end thereof away from the connection portion and extends from the bending portion longitudinally;

a first arc-shaped band horizontally extending from one side of the first finger portion and bending toward an opposite side of the first finger portion, wherein the first arc-shaped band surrounds the index finger;

a second arc-shaped band horizontally extending from one side of the second finger portion and bending toward an opposite side of the second finger portion, wherein the second arc-shaped band surrounds the middle finger;

a third arc-shaped band horizontally extending from one side of the connection portion and bending toward an opposite side of the connection portion, wherein the third arc-shaped band surrounds the index and middle finger;

a fourth arc-shaped band horizontally extending from one side of the third finger portion and bending toward an opposite side of the third finger portion, wherein the fourth arc-shaped band surrounds the thumb; and a multiple folding lines portion between the first finger portion and the second finger portion, wherein the multiple folding lines portion has two folding lines defined therein, wherein the multiple folding lines portion has a circular arc shape, and the two folding lines extend radially and are spacedly arranged, wherein the bending portion is bent such that the first finger portion and the second finger portion face away from the third finger portion, wherein the first, second, third finger portions, the connection portion, the bending portion, and the first, second, third, and fourth bands, and the multiple folding lines portion are monolithic.

2. The disposable food grasping device of claim 1, further comprising:

a first cover portion extending from a distal end of the first finger portion and bending toward and attached to the first arc-shaped band;

a second cover portion extending from a distal end of the second finger portion and bending toward and attached to the second arc-shaped band; and a third cover portion extending from a distal end of the third finger portion and bending toward and attached to the fourth arc-shaped band.

3. The disposable food grasping device of claim 1, wherein the bending portion has a third folding line defined in an end area thereof adjacent to the connection portion, wherein the third folding line include two diagonal lines intersecting each other and a horizontal line passing the intersection of the diagonal lines.

* * * * *